US009199107B2

(12) United States Patent
Kjellberg

(10) Patent No.: US 9,199,107 B2
(45) Date of Patent: Dec. 1, 2015

(54) SPRINKLER AND METHOD FOR TESTING A SPRINKLER

(75) Inventor: Anders Kjellberg, Onsala (SE)

(73) Assignee: ULTRA FOG AB, Hisings Backa (SE)

( * ) Notice: Subject to any disclaimer, the term of this patent is extended or adjusted under 35 U.S.C. 154(b) by 177 days.

(21) Appl. No.: 13/812,263

(22) PCT Filed: Jun. 21, 2011

(86) PCT No.: PCT/SE2011/050807

§ 371 (c)(1),
(2), (4) Date: Jan. 25, 2013

(87) PCT Pub. No.: WO2012/015351

PCT Pub. Date: Feb. 2, 2012

(65) Prior Publication Data

US 2013/0126194 A1 May 23, 2013

(30) Foreign Application Priority Data

Jul. 28, 2010 (SE) ..... 1050835

(51) Int. Cl.

| | |
|---|---|
| ***A62C 37/08*** | (2006.01) |
| ***A62C 37/50*** | (2006.01) |
| ***A62C 31/07*** | (2006.01) |
| ***A62C 35/58*** | (2006.01) |

(52) U.S. Cl.

CPC ..... *A62C 37/50* (2013.01); *A62C 31/07* (2013.01); *A62C 35/58* (2013.01)

(58) Field of Classification Search

USPC ..... 169/37, 43

See application file for complete search history.

(56) References Cited

U.S. PATENT DOCUMENTS

| | | | |
|---|---|---|---|
| 3,874,455 | A | 4/1975 | Klesow |
| 4,434,855 | A | 3/1984 | Given, Jr. |
| 5,373,989 | A | 12/1994 | Hattori |
| 2002/0083982 | A1 | 7/2002 | Gibb |
| 2009/0188683 | A1 | 7/2009 | Mchugh et al. |

OTHER PUBLICATIONS

International Search Report, corresponding to PCT/SE2011/050807, mailed Nov. 23, 2011.

Written Opinion, corresponding to PCT/SE2011/050807, mailed Nov. 23, 2011.

*Primary Examiner* — Len Tran

*Assistant Examiner* — Adam J Rogers

(74) *Attorney, Agent, or Firm* — Renner, Otto, Boisselle & Sklar, LLP

(57) ABSTRACT

A sprinkler head and a method for testing the sprinkler head, including an inlet device to lead fire-extinguishing medium and air from a distribution system into the sprinkler head, an outlet device to release fire-extinguishing medium and air from the sprinkler head, a flow passage to lead fire-extinguishing medium and air from the inlet device to the outlet device, a valve to be held in first non-activated state by a triggering device in the sprinkler head, so the flow passage is closed, and in activated state to open the flow passage, when the triggering device is activated in a heated state, so air and fire-extinguishing medium may flow from the inlet device to the outlet device. The valve in a second non-activated test state operatively opens the flow passage, so air and fire-extinguishing medium may flow from the inlet device through the flow passage and out through the outlet device.

12 Claims, 8 Drawing Sheets

SPRINKLER AND METHOD FOR TESTING A SPRINKLER

TECHNICAL FIELD

The present invention relates to a sprinkler head and a method in a sprinkler head for testing and/or de-airing a sprinkler system.

BACKGROUND

Sprinkler systems have for many years been used to dampen and/or to extinguish fire in different spaces, e.g. in offices, industrial premises, hotels, apartments or shops etc. A sprinkler system in most cases comprises a piping network or the like extending through the space that the sprinkler system is to protect in case of fire. The piping network is in most cases connected to a pressurized water supply and it may be divided into several branches, each of which may extend through different parts of the space concerned. In the various branches, one or more sprinkler heads are mounted. Each sprinkler head has a heat-sensitive triggering device. The triggering device is arranged to activate the sprinkler head if a fire breaks out near the sprinkler head. When the sprinkler head is activated, the sprinkler head spreads water from the piping network out over the fire and prevents it from spreading and/or ensures that it is extinguished.

There are two main categories of sprinkler systems, wet sprinkler systems and dry sprinkler systems. In an operative wet sprinkler system, there is pressurized water in the piping network both when the sprinkler system is in a non-activated state and when the sprinkler system is in an activated state. In an operative dry sprinkler system, there is no water or very little water in the piping network when the sprinkler system is in a non-activated state. Instead the piping network is supplied with water when a fire has been detected. Dry sprinkler system may advantageously be used in spaces exposed to large temperature variations. This is particularly appropriate if the sprinkler system run the risk of being exposed to cold that would freeze any possible water in the piping system and be able to burst the pipes resulting in leakage. Wet sprinkler systems are in other words typically used in spaces not running the risk of being exposed to cold that could freeze the water in the piping network.

In a wet sprinkler system water flow detectors may be used to detect when one or more sprinkler heads have been activated and spread water. One or more water flow detectors may be arranged in one or more branches of the piping system for detecting activation of one or more sprinkler heads in a branch. The activation of a sprinkler head usually indicates that a fire has broken out in a protected space and the space concerned should then be evacuated and fire department called. It is thus important to as safely as possible be able to detect that a sprinkler head has been activated, as it normally means that a fire has broken out.

Water flow detectors of now described and kind and the like thus have an important function in many wet sprinkler system and the water flow detectors should therefore be tested continuously to ensure that they from time to time work as intended.

It is also important that the water flow detectors of now described and kind and the like are reliable, i.e. that no or very few false alarms occur. One reason for false alarm is that air has gathered in one or more branches of the piping system in a wet sprinkler system. Because air may be compressed, the water in the piping system may begin moving without any sprinkler head having been activated. This may e.g. happen in spaces which are moving, e.g. in spaces on boats equipped with sprinkler systems, where rough sea may make the water in the piping system of the sprinkler system move, if air is gathered in one or more branches of the piping system. A water flow detector may detect such movements of the water and incorrectly indicate that a sprinkler head has been activated. It is thus important that any possible air may be removed from different branches of the piping system of a wet sprinkler system.

On the whole, it is advantageous if the function of a sprinkler system in whole or in part may be tested in a simple and quick way in different branches of the piping system of the sprinkler system.

SUMMARY

Embodiments of the present invention provide a sprinkler head, the function of which may be tested during normal operation of the sprinkler system. The sprinkler head does for example not need to be dismounted to be tested and the sprinkler system does not need to be set in a special test mode, but may remain in normal operation. For example the pressure in the supply system normally neither needs to be lowered nor raised to allow for a test. The function of the sprinkler system may be tested in each position where a sprinkler head according to embodiments of the present invention is connected to the distribution system. In addition, the test is so simple that no special previous knowledge is required to perform the test.

Sprinkler systems that are provided with sprinkler heads in accordance with embodiments of the present invention may thus be tested easily and quickly. Such sprinkler systems may therefore be tested often without great expenses. Such sprinkler systems may also be tested without interference with the function of the sprinkler system, which may be maintained essentially unchanged during the testing procedure. Because the sprinkler system with sprinkler heads in accordance with embodiments of the present invention may be tested (even often), they may ensure a greater functional reliability compared to other sprinkler systems with sprinkler heads that may not be tested, or that may not be tested in a simple way.

Testing of a sprinkler head according to an embodiment of the present invention also means that any possible air may be removed from the branch of the piping system in which the sprinkler head is arranged. This reduces the risk that the water in the piping system begins to move without any sprinkler head has been activated, which reduces the risk that a possible water flow detector incorrectly will indicate that a sprinkler head has been activated.

At least one of the improvements and/or advantages mentioned above may be accomplished in accordance with a first embodiment of the present invention which is directed to a sprinkler head comprising an inlet device configured to operatively lead a fire-extinguishing medium and air from a distribution system into the sprinkler head, and a outlet device configured to operatively release fire-extinguishing medium and air from the sprinkler head, and a flow passage configured to lead fire-extinguishing medium and air from the inlet device to the outlet device, and a valve device configured to operatively be maintained in a first non-activated state by a triggering device in the sprinkler head, so that the flow passage is closed, and configured to in an active state operatively open the flow passage when the triggering device is activated in a heated state, so that air and fire-extinguishing medium may flow from the inlet device to the outlet device. The valve device is configured to in a second non-activated test state operatively open the flow passage, so that air and fire-extinguishing medium may flow from the inlet device through the flow passage and out through the outlet device.

At least one of the improvements and/or advantages mentioned above may be accomplished in accordance with a first embodiment of the present invention directed to a method for testing a sprinkler head. The sprinkler head comprises: a valve device which is held in a first non-activated state by a triggering device in the sprinkler head and closes a flow passage, which is configured to lead fire-extinguishing medium and air from a distribution system to an outlet device which is configured to operatively release air and fire-extinguishing medium from the sprinkler head, where the valve device further is configured to in an active state operatively open the flow passage when the triggering device has been activated in a heated condition, so that air and fire-extinguishing medium may flow from the distribution system to the outlet device. The method comprises the activity to: set the valve device in a second non-activated test state that opens the flow passage, so that air and fire-extinguishing medium may flow from the distribution system via the flow passage and out through the outlet device.

Further advantages of the invention and embodiments of this will be evident from the detailed description below.

It should be emphasized that the term "comprising/comprises" when used herein shall be interpreted in such a way that it specifies the presence of the indicated features, activities, steps, components or the like thereby without ruling out the presence or addition of one or more other features, activities, steps, components or the like.

DETAILED DESCRIPTION OF EMBODIMENTS

Figure 1:
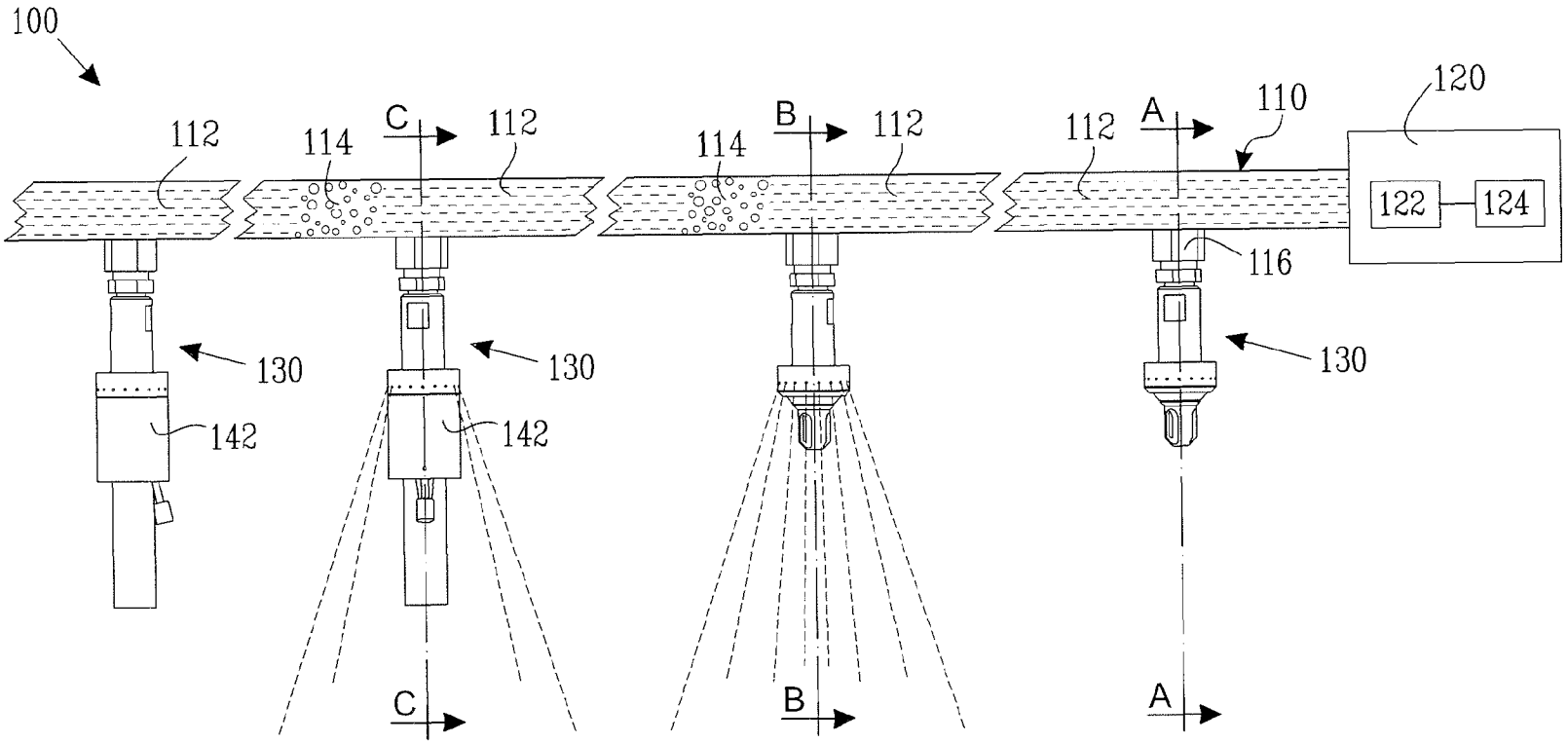
FIG. 1 is a schematic diagram of an exemplifying sprinkler system 100 comprising at least one sprinkler head 130 according to an embodiment of the present invention.
Figure 2:
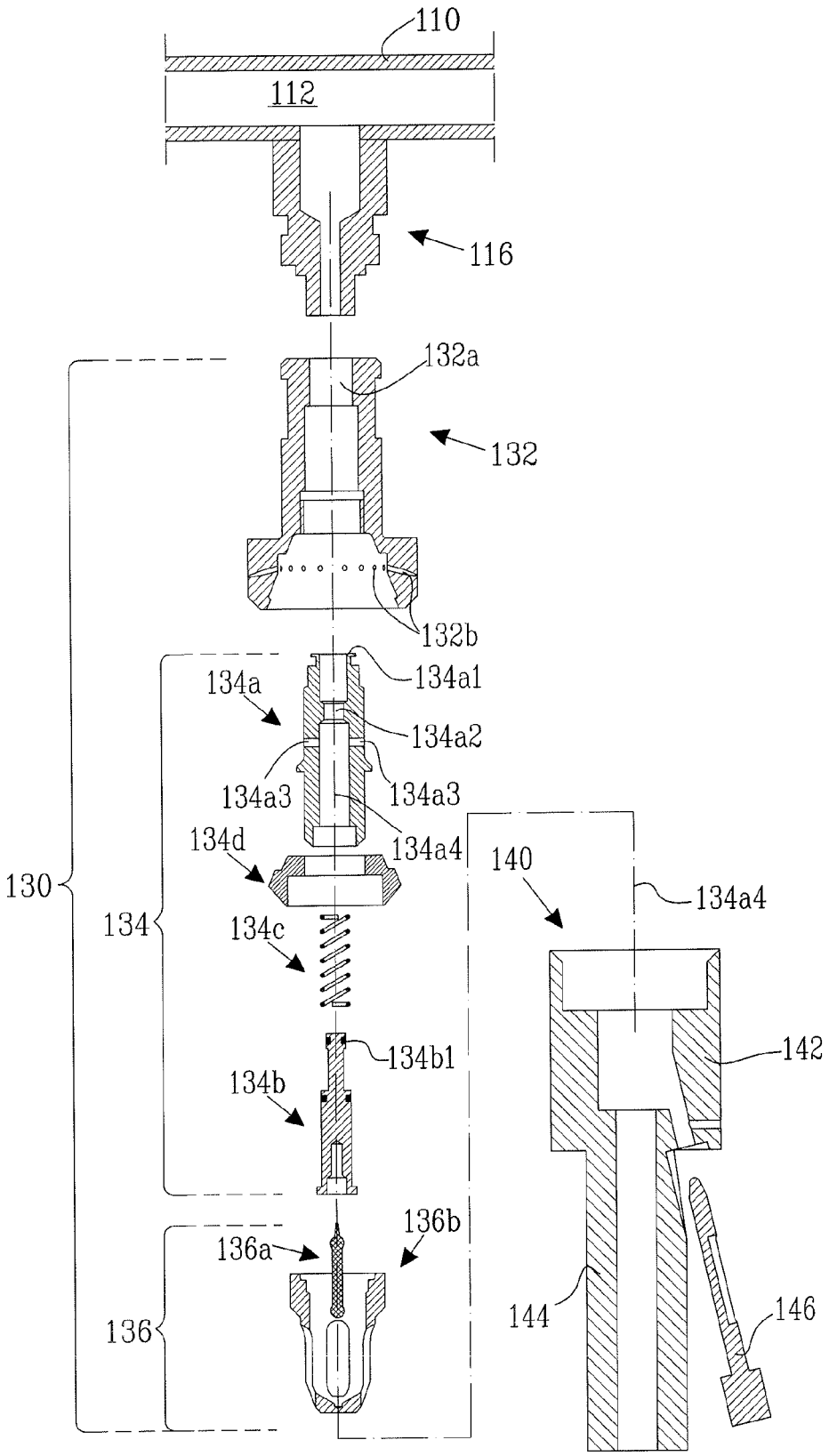
FIG. 2 is an exploded view of the sprinkler head 130 in a cross section viewed according to the section line A-A in FIG. 1.
Figure 3:
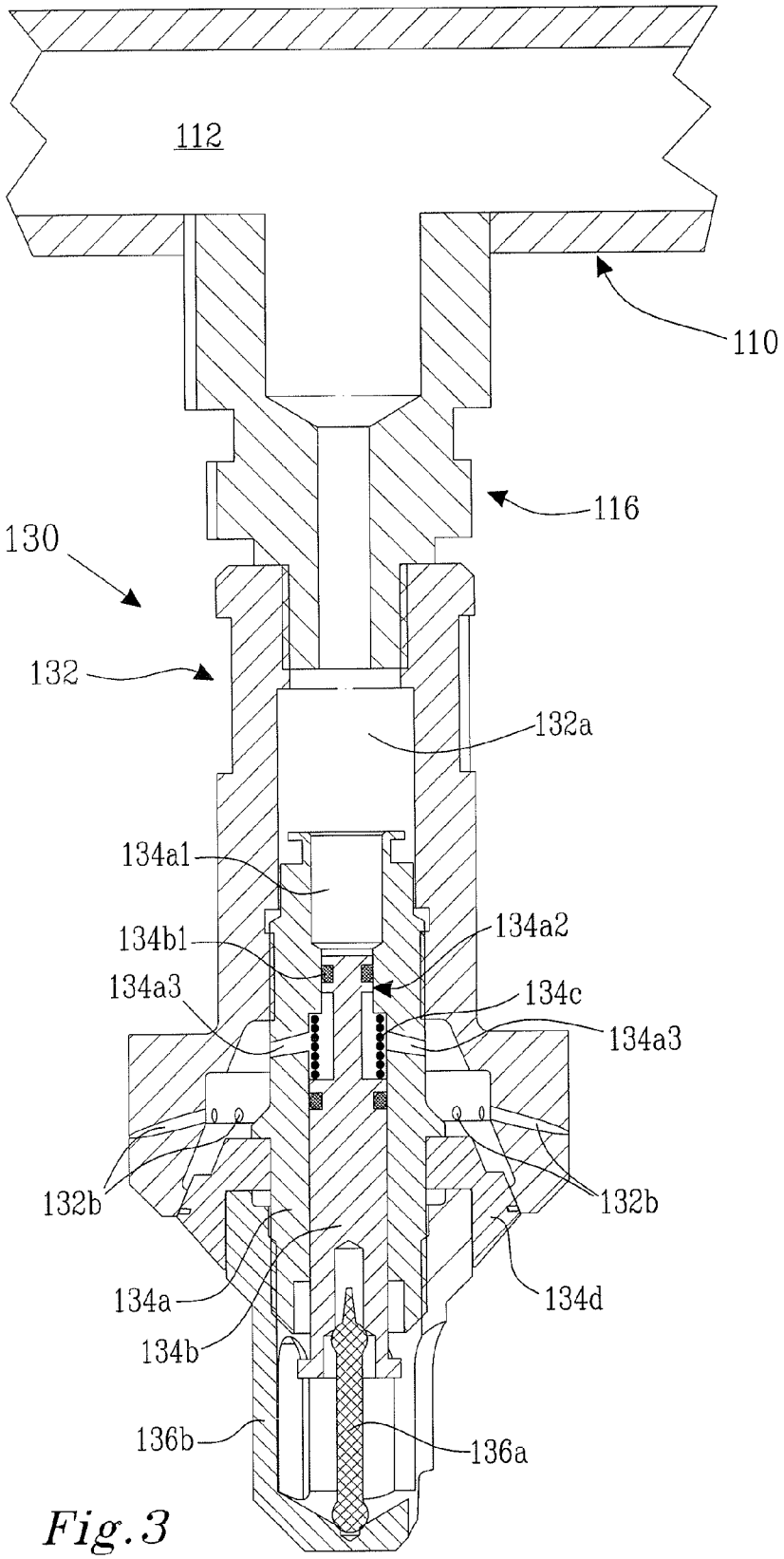
FIG. 3 is a composite sketch of the sprinkler head 130 in a non-activated state viewed according to the section line A-A in FIG. 1.
Figure 4:
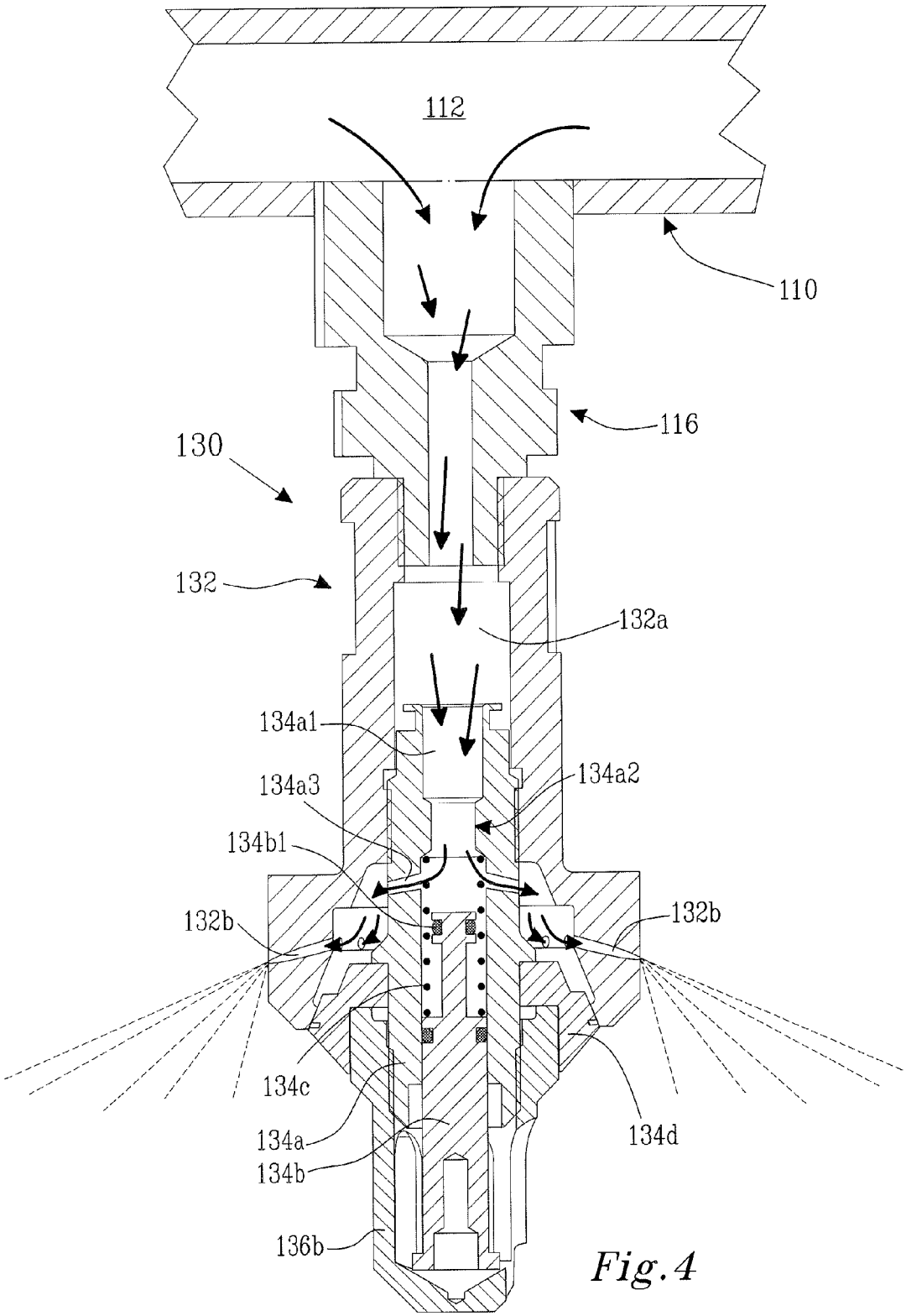
FIG. 4 is a cross section of the sprinkler head 130 in an activated state viewed according to the section line B-B in FIG. 1.
Figure 5:
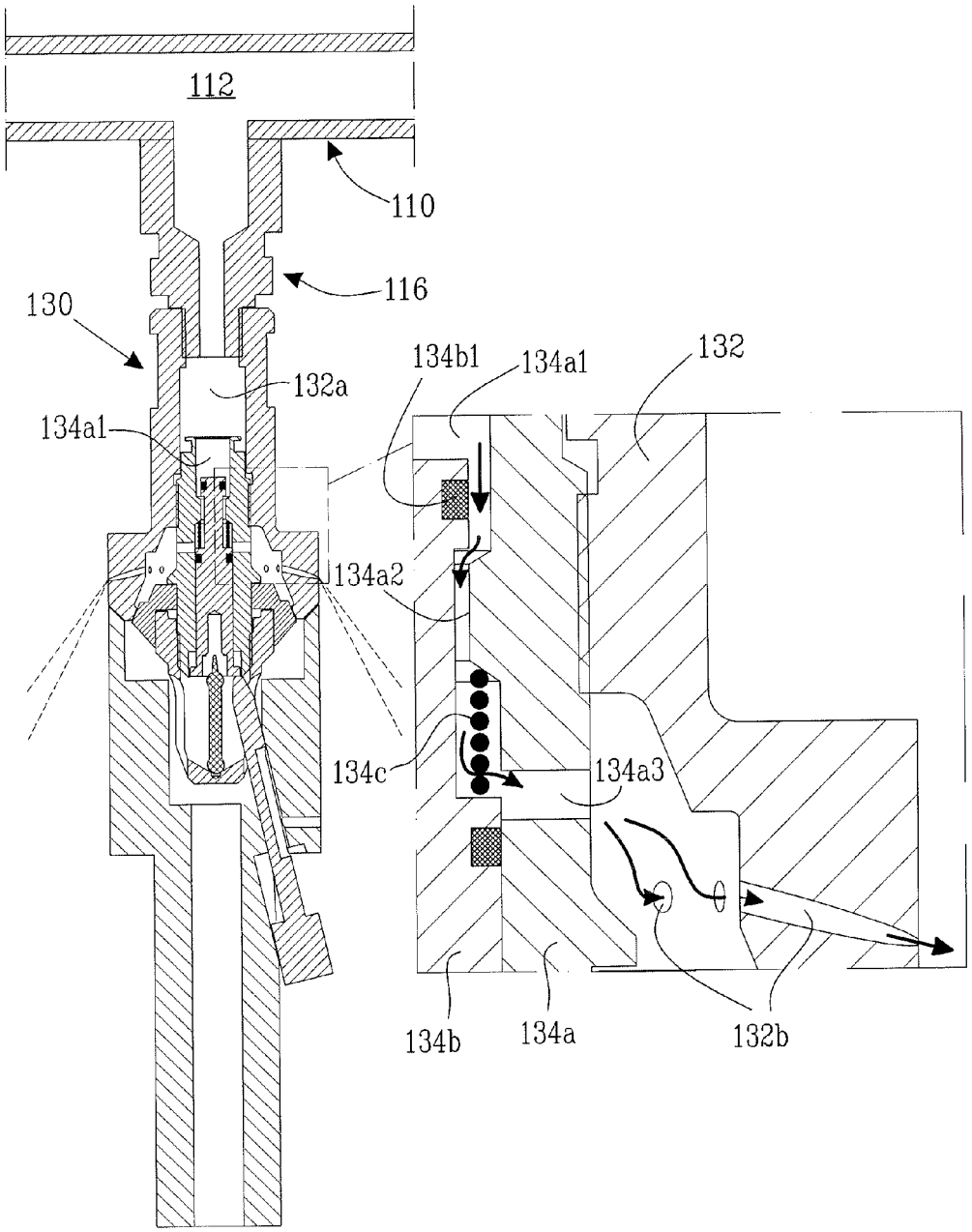
FIG. 5 is a cross section of the sprinkler head 130 in a non-activated test state viewed according to the section line C-C in FIG. 1.

FIG. 1 shows a schematic view of an exemplifying sprinkler system 100. The sprinkler system 100 comprises a distribution system 110, a supply system 120 and one or more sprinkler heads 130. FIG. 2 is an exploded view of the sprinkler head 130 in a cross section viewed according to the section line A-A in FIG. 1. FIG. 3 is a composite sketch of the sprinkler head 130 in a non-activated state viewed according to the section line A-A in FIG. 1. FIG. 4 is a cross section of the sprinkler head 130 in an activated state viewed according to the section line B-B in FIG. 1. FIG. 5 is a cross section of the sprinkler head 130 in a non-activated test state viewed according to the section line C-C in FIG. 1.

The sprinkler head 130 is configured to operatively spread fire-extinguishing medium from a distribution system 110 to the closest surroundings of the sprinkler head 130. The sprinkler head 130 comprises an inlet device 132 that is configured to operatively be connected to the distribution system 110. The inlet device 132 is configured to lead the fire-extinguishing medium 112 from the distribution system 110 into the sprinkler head 130. The sprinkler head 130 further comprises an outlet device 132*b* which is connected to the inlet device 132 via a flow passage. The outlet device 132*b* is configured to operatively spread the fire-extinguishing medium 112 to the surroundings with the fire-extinguishing or fire-dampening effect. The sprinkler head 130 further comprises a valve device 134 that is configured to operatively close and open the flow passage. The sprinkler head 130 also comprises a triggering device 136 that is configured to in a first non-activated state to keep the valve device 134 closed, so that the flow passage is closed and in an activated heated state open the valve device 134, so that the fire-extinguishing medium 112 may flow from the inlet device 132 through the flow passage and out through the outlet device 132*b*. The valve device 134 of the sprinkler head 130 is particularly configured to in a second non-activated test state operatively open the flow passage, so that air 114 and/or fire-extinguishing medium 112 may flow from the inlet device 132 through the flow passage and out through the outlet device 132*b*. This has a de-airing effect for any possible air 114 in the distribution system 110 and/or releasing effect for the fire-extinguishing medium 112.

That the sprinkler head 130 spreads fire-extinguishing medium 112 with fire-extinguishing or fire-dampening effect does not necessarily mean that any possible fire may be extinguished by the sprinkler head 130. For example, the sprinkler heads that spread fire-extinguishing medium in the form of water may not easily extinguish burning oil. Fire-extinguishing medium in the form of water may even be totally inappropriate to extinguish some burning metals, such as potassium, sodium, magnesium or the like. Fire-extinguishing or fire-dampening effect rather means that the most common forms of fire that may occur in the spaces covered by the distribution system 110 may be extinguished or at least be dampened by the fire-extinguishing medium 112.

A more detailed description of the sprinkler head 130 will be given later.

With the exception of the sprinkler head 130, the sprinkler system 100 and the like sprinkler systems are well known to a person skilled in the art. The sprinkler system 100 as such therefore requires no detailed description. Below is anyway given an overview of parts of the sprinkler system 100 that are relevant for embodiments of the present invention.

The distribution system 110 is configured to distribute fire-extinguishing medium 112 to one or more spaces where fire-extinguishing effect is desired in case of fire or the like. The space in question may be premises of various kinds, e.g. hotel rooms, office rooms, corridors, warehouses, industrial premises, machine rooms, computer rooms or other similar spaces. The space may also comprise spaces which temporary or permanently are located outdoors or which in different contexts come in contact with outdoor climate, e.g. because a door or a gate being opened or even because the space lacks heating. Naturally, this may impose specific requirements on the fire-extinguishing medium 112, which preferably should remain in liquid form and therefore should not freeze or in any other way solidify. The distribution system 110 may for example consist of a piping system or a channel system or the like which is made of a suitable material that has been given an appropriate design.

It is preferred that the distribution system 110 branches off from the supply system 120 and out into the space where the fire-extinguishing effect is desired. One or more sprinkler heads 130 may be connected to the distribution system 110 in an essentially arbitrary position, e.g. in every space whereto fire-extinguishing medium 112 is distributed by the distribution system 110 and where fire-extinguishing effect is desired, e.g. in each room where fire-extinguishing effect is desired.

The supply system 120 is configured to operatively pump and/or lead in fire-extinguishing medium 112 into the distribution system 110. The supply system 120 may for example be connected to a suitable water supply, such as a municipal water supply or the like. It is preferred that the supply system 120 is configured to maintain an appropriate pressure on the fire-extinguishing medium 112 in the distribution system 110. It is preferred that the supply system 120 is configured to operatively maintain an appropriate pressure on the fire-extinguishing medium 112 both when the sprinkler system 100 is in a non-activated normal state and in an activated fire-extinguishing state. To keep an appropriate pressure on the fire-extinguishing medium 112 the supply system 120 may for example comprise a pressure control device 122 that is configured to pump and/or lead fire-extinguishing medium 112 into the distribution system 110. Pressure control device 122 may for example comprise a pumping device and/or a valve device or a similar device for pressurization of the fire-extinguishing medium 112. Pressure control device 122 may also comprise a pressure sensor device for measuring the present pressure of the supply system 120. Pressure control device 122 may be operatively controlled by a supply management system 124, so that the fire-extinguishing medium 112 is kept under an appropriate pressure. The supply management system 124 may be configured to control said pump devices and/or valve devices in the pressure control device 122, e.g. by means of the pressure sensor device.

The fire-extinguishing medium 112 is preferably a liquid medium that may flow from the supply system 120 through the distribution system 110 to the sprinkler head 130 and be spread out from there. The fire-extinguishing medium 112 may for example be water or the like, or water mixed with one or more other appropriate substances or liquids, or similar. The fire-extinguishing medium 112 could for example be mixed with a substance or liquid making the fire-extinguishing medium 112 not risking solidifying, e.g. not freezing at low temperatures.

FIGS. 2, 3, 4 and 5 show details of the exemplifying sprinkler head 130 according to an embodiment of the present invention. An exploded view of the sprinkler head 130 and the testing device 140 is shown in FIG. 2 viewed according to section line C-C in FIG. 1. A composite drawing of the sprinkler head 130 is shown in the first non-activated state in FIG. 3 viewed according to section line A-A in FIG. 1. A composite drawing of the sprinkler head 130 is shown in the activated state in FIG. 4 viewed according to section line B-B in FIG. 1. A composite drawing of the sprinkler head 130 is shown in the second non-activated test state in FIG. 5 viewed according to section line C-C in FIG. 1.

The sprinkler head 130 comprises an inlet device 132 configured to operatively lead a fire-extinguishing medium 112 and air 114 from the distribution system 110 into the sprinkler head 130. The sprinkler head 130 also comprises an outlet device 132*b* configured to operatively release fire-extinguishing medium 112 and air 114 from the sprinkler head 130. The sprinkler head 130 further comprises a flow passage configured to lead fire-extinguishing medium 112 and 114 from the inlet device 132 to the outlet device 132*b*. The sprinkler head 130 also comprises a valve device 134 configured to be operatively held in a first non-activated state of a triggering device 136 in the sprinkler head 130, so that the flow passage is closed. Valve device 134 is further configured to in an active state operatively open the flow passage when the triggering device 136 is activated in a heated state, so that the air 114 and fire-extinguishing medium 112 may flow from the inlet device 132 to the outlet device 132*b*. The valve device 134 is also configured to in a second non-activated test state operatively open flow passage so that air 114 and fire-extinguishing medium 112 may flow from the inlet device 132 through the flow passage and out through the outlet device 132*b*.

The inlet device 132 is configured to operatively lead fire-extinguishing medium 112 into the sprinkler head 130 from the distribution system 110. For this purpose, the inlet device 132 may for example be configured to operatively be connected to a connection device 116 of the distribution system 110, such that an inlet 132*a* of the inlet device 132 may lead fire-extinguishing medium 112 from the distribution system 110 into the sprinkler head 130. How the sprinkler head 130 is connected to the distribution system 110 is not important, provided that the fire-extinguishing medium 112 may flow into the sprinkler head 130 from the distribution system, the 110. The connection may for example occur by means of a screw coupling, a bayonet coupling or by gluing, soldering or welding or in any other appropriate manner. The inlet device 132 shown in FIG. 2 comprises an outlet device 132*b* configured to operatively spread fire-extinguishing medium 112 from the sprinkler head 130 to the surroundings with fire-extinguishing effect. Outlet device 132*b* is connected to the inlet device 132 via a flow passage (indicated by large arrows in FIG. 4 and FIG. 5, described detailedly below) so that the fire-extinguishing medium 112 may flow from the inlet 132*a* to the outlet device 132*b*. Embodiments of the sprinkler head 130 may have a plurality of flow passages connecting the inlet device to one or more outlet devices. Embodiments of the sprinkler head 130 may have the outlet device 132*b* arranged in any other place than at the inlet device 132. For example, an outlet device with the same or similar function as the outlet device 132*b* may be arranged on the valve device 134 and/or the triggering device 136. In the embodiment of the sprinkler head 130 shown in FIG. 2, the outlet device 132*b* has a number of holes. The holes are preferably arranged in a circle around the inlet device 132 so that the holes essentially extend radially from the center of the inlet device 132 to the periphery of the inlet device 132. Other types of outlet devices with one or more holes or the like are clearly conceivable.

The valve device 134 is configured to operatively close and open the aforementioned flow passage (indicated by large arrows in FIG. 4 and FIG. 5, described detailedly below). In the first non-activated state, the valve device 134 is configured to operatively close the flow passage, see FIG. 3. In the activated state, the valve device 134 is configured to operatively open the flow passage so that fire-extinguishing medium 112 may flow from the inlet device 132 via the flow passage and out through the outlet device 132*b* with a fire-extinguishing or fire-dampening effect, see FIG. 4. In the second non-activated test state valve device 134 is configured to operatively open the flow passage so that air 114 and/or fire-extinguishing medium 112 may flow from the inlet device 132 via the flow passage and out through the outlet device with a de-airing effect, see FIG. 5. From e.g. FIG. 2 it may be concluded that the valve device 134 comprises a valve body 134*a* and a flow control device 134*b* (e.g. a piston device). The valve device 134 may also comprise a biasing means 134*c* (e.g. a spring) and a fastening device 134*d*.

The valve body 134*a* in FIG. 2 is configured to be operatively connected to the inlet device 132 of the sprinkler head 130 so that a valve body inlet 134*a*1 of the valve body 134*a* may lead fire-extinguishing medium 112 from the distribution system 110 via the inlet device 132 into the valve body 134*a*. How the valve body 134*a* is connected to the inlet device 132 of the sprinkler head 130 is not important, provided that fire-extinguishing medium 112 may flow from the distribution system 110 into the valve body 134*a*. The connection may for example occur by means of a fastening device 134*d*. The fastening device 134*d* may, for example be configured to be screwed into the inlet device 132 so that the valve body is tensioned and fixed to the inlet device 132. Alternatively, the valve body 134*a* may be connected to the inlet device 132 of the sprinkler head 130 using a bayonet coupling or by gluing, soldering or welding or in any other appropriate way. The exemplifying valve body 134*a* has a tubular interior with a tubular and tapered flow control waist 134*a*2 which extends along a portion of the tubular interior of the valve body 134. The flow control waist 134*a*2 is configured to operatively cooperate with the flow control device 134*b* so that the aforementioned flow passage may be closed and opened. The valve body 134*a* also comprises a valve body outlet 134*a*3. The valve body outlet 134*a*3 is connected to the valve body inlet 134*a*1 via the tubular interior of the valve body and flow control waist 134*a*2 so that the fire-extinguishing medium 112 may flow from the valve body inlet 134*a*1 to valve body outlet 134*a*3 and further to the first outlet device 132*b* of the inlet device 132.

From the above description the observant reader realizes that said flow passage (indicated by large arrows in FIG. 4 and FIG. 5) is formed by the inlet 132*a* and the outlet device 132*b* of the inlet device 132, and the valve body inlet 134*a*1, the flow control waist 134*a*2 and valve body outlet 123*a*3 of the valve device 134. Through the flow passage, fire-extinguishing medium 112 may flow from the inlet 132*a* to the outlet device 132*b* of the inlet device 132, via valve body inlet 134*a*1, flow control waist 134*a*2 and the valve body outlet 123*a*3 of the valve device 134. From the outlet device 132*b* the fire-extinguishing medium 112 may be spread from the sprinkler head 130 to the surroundings with fire dampening or fire-extinguishing effect (see FIG. 4). From the outlet device 132*b* may alternatively fire-extinguishing medium 112 and/or air 114 be spread from the sprinkler head 130 to the surroundings with testing and/or de-airing effect (see FIG. 5).

As mentioned earlier, the flow control device 134*b* is configured to operatively cooperate with the valve body 134 so that the flow passage may be closed and opened. To accomplish this, the flow control device 134*b* may e.g. be provided with a flow seal 134*b*1 which is configured to operatively seal against the valve body 134, e.g. against the flow control waist 134*a*2 as e.g. shown in FIG. 4. The flow seal 134*b*1 may e.g. be a mechanical seal device, e.g. an o-ring or the like. It is preferred that the flow control device 134*b* is arranged to operatively move from a first position closing the flow passage in the first non-activated state (see FIG. 3) to a second position opening the first flow passage in the activated state (see FIG. 4), and to operatively move from the first position to a third test position which opens the flow passage in the second non-activated test state (see FIG. 5). It is preferred that the flow control device 134*b* is arranged inside the valve body 134*a*, e.g. in the tubular interior of the valve body 134*a*. Naturally, the flow control device may be arranged in another way, e.g. outside of a valve body or the like, e.g. enclosing a valve body or the like. The flow control device 134*b* shown in FIG. 2 is a piston-like device that is configured to operatively move along an axis of the valve body 134*a*, e.g. the center axis 134*a*4 of the valve body 134*a*. The center axis 134*a*4 of the valve body 134*a* and the center axis of the sprinkler head 130 may be the same.

It is preferred that the flow control device 134*b* is biased against the triggering device 136 and/or triggering unit 136*a* of the trigging device 136. It is preferred that the flow control device 134*b* by means of the biasing may be pressed from the first position which closes the flow passage of the first non-activated state (see FIG. 3) to the second position which opens the first flow passage in the activated state (see FIG. 4), and so that the flow control device 134*b* may be pressed against the biasing from the first position to the third position which opens the flow passage in the second non-activated state (see FIG. 5). In order to create the biasing of the flow control device 134*b*, a biasing device 134*c* may be used. The biasing device 134*c* may e.g. be a spring device or similar device, such as a coil spring or the like. The biasing device 134*c* may e.g. be arranged inside the valve body 134*a* between the valve body 134*a* and the flow control device 134*b*, e.g. as shown in FIGS. 3, 4 and 5.

Attention is now directed against the triggering device 136 of the exemplifying sprinkler head 130. The triggering device 136 is configured to operatively hold the valve device 134 closed in the first non-activated state and to open the valve in the activated state. The triggering device 136 may comprise a triggering unit 136*a*. The triggering device 136 may also comprise a triggering bracket 136*b* arranged to hold triggering unit 136*a* in place.

The triggering unit 136*a* is configured to operatively hold the valve device 134 closed in the first non-activated state and to open the valve device 134 in the activated state. The embodiment of the triggering unit 136*a* which is shown in FIG. 2 may consist of a container that is made of an essentially rigid material. The container contains a substance that expands when the substance is heated so that the container cracks and collapses (is activated). The triggering device 136*a* may, for example be a frangible glass container with a liquid that is expanding rapidly, when the liquid is exposed to increasing temperature, so that the glass container explodes, preferably at a predetermined temperature. When a triggering device 136*a* in the form of the now-mentioned container is exploded and collapses, the container completely or partly disappears. The flow control device 134*b*, which is held by the triggering device 136*a*, then is pressed by the above-mentioned biasing from the first position, which closes the flow passage in the first non-activated state (see FIG. 3), to the second position, which opens the first flow passage in the now activated state (see FIG. 4).

The triggering bracket 136*b* is arranged to hold the triggering device 136*a* in place such that the triggering unit 136*a* may hold the valve device 134 closed in the first non-activated state. As previously described with reference to for example FIG. 2 and FIG. 3, the triggering unit 136*a* abuts in the first non-activated state against the triggering bracket 136*b* so that the triggering unit 136*a* is held against the flow control device 134*b*, which in turn is biased against the triggering unit 136*a*. From FIG. 3 it may be concluded that the flow control device 134*b* then closes the flow passage (indicated by large arrows in FIG. 4 and FIG. 5). This may occur by means of flow seal 134*b*1 sealing against flow control waist 134*a*2 of the valve body 134*b*. Other flow control devices of other embodiments may seal the flow passage in another way. As may be concluded from for example FIG. 3 and FIG. 4, the triggering bracket 136*a* is a part of the sprinkler head 130. The triggering unit 136*a* may for example be connected against the valve body 134*a* or against the inlet device 132 or against any other part of the sprinkler head 130. The connection may for example occur by means of a screw connection, a bayonet coupling or by gluing, soldering or welding or in any other appropriate manner.

A testing device 140 may be used to influence the valve device 134, being in the second non-activated state, to open the flow passage so that air 114 and/or fire-extinguishing medium 112 may flow from the inlet device 132 through the flow passage and out through the outlet device 132*b*. It is preferred that the testing device 140 has a fixation unit 142 that is designed to fix the testing device in relation to the sprinkler head 130. The fixation unit 142 may, for example consist of a bowl-shaped portion or other recess that is configured to at least partially enclose the sprinkler head 130 so that the testing device may be fixed in relation to the sprinkler head 130. It is further preferred that the bowl-shaped portion 142 is arranged on a rod 144. The rod 144 may, for example be longer than one meter, or longer than 1.5 meters, or longer than 2 meters. It is the preferred that the rod is not longer than 5 meters. The rod 144 may have a telescoping function with the effect that the rod 144 may be pushed out and/or pulled together. It is preferred that the bowl-shaped portion 142 comprises a short rod-like activation part 146 or the like that is configured to be operatively applied against the sprinkler head 130 and press the flow control device 134*b* to the third position in the second non-activated state (see FIG. 5). An advantage of using a testing device 140 with a bowl-shaped portion 142 arranged on a long rod 144 is that the operator pressing flow control device 134*b* to the third position may be at a distance away from the sprinkler head 130, which may be appropriate in those cases the sprinkler head 130 is located high up in a ceiling and the operator may stand on the floor and still fix the testing device 140 and the bowl-shaped portion 142 with the activation part 146 against the sprinkler head 130 so that the flow control device 134*b* may easily be pushed to the third position.

Above, the sprinkler head 130 has been described with reference to FIGS. 1-5. As already mentioned, the sprinkler head 130 is only one embodiment of the present invention.

Figure 6C:
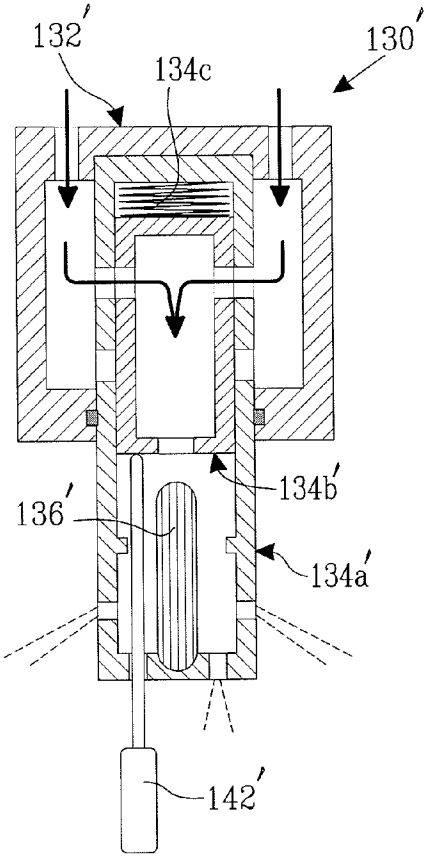
FIG. 6*c* shows the sprinkler head 130' in FIG. 6*a* in a non-activated test state.
Figure 6B:
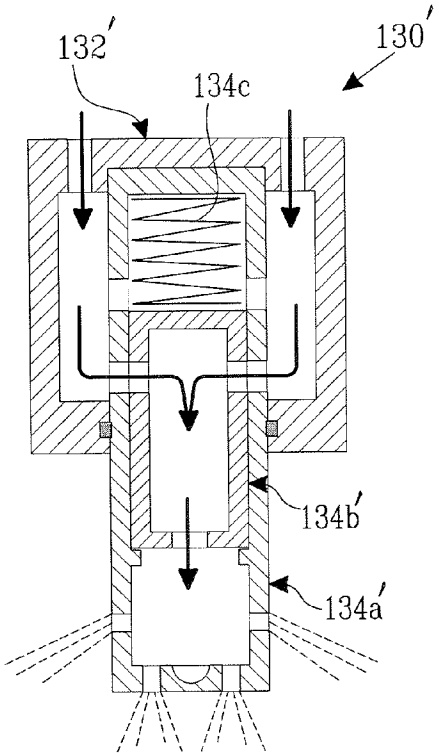
FIG. 6*b* shows the sprinkler head 130' in FIG. 6*a* in an activated state.
Figure 6A:
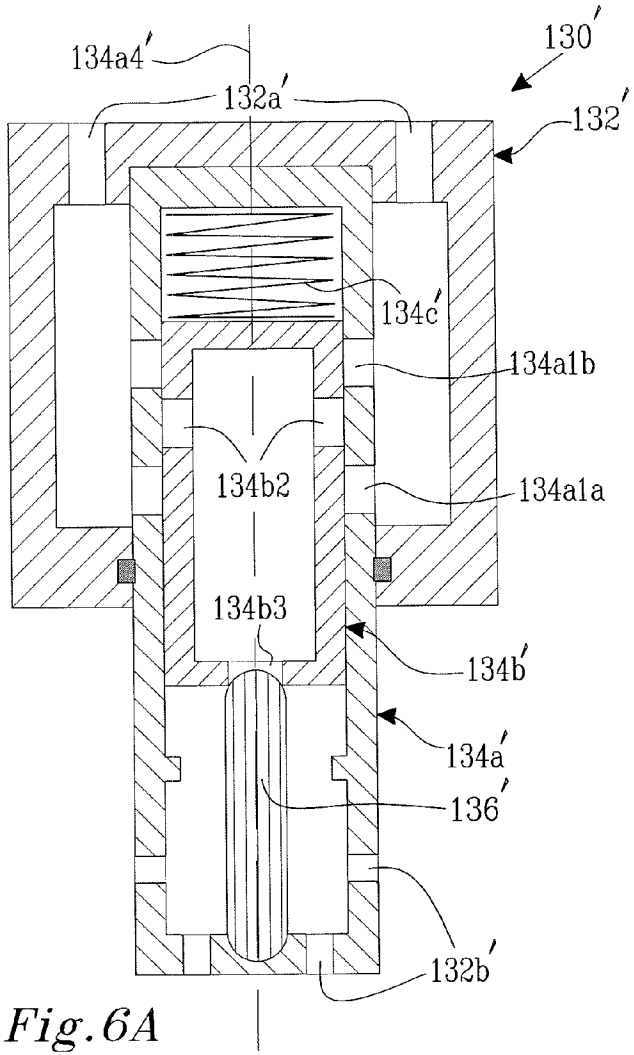
FIG. 6*a* is a schematic cross-section of a sprinkler head 130' shown in a non-activated state according to an embodiment of the present invention.

Below a sprinkler head 130' is described with reference to FIGS. 6*a*, 6*b*, 6*c*. The sprinkler head 130' is another embodiment of the present invention. FIG. 6*a* is a schematic cross-section of the sprinkler head 130' shown in a first non-activated state. FIG. 6*b* shows the sprinkler head 130' of FIG. 6*a* in an activated state, and FIG. 6*c* shows the sprinkler head 130' in FIG. 6*a* in a second non-activated test state.

The sprinkler head 130' comprises an inlet device 132' that is configured to be operatively connected to the distribution system 110 such that an inlet 132*a*' of the inlet device 132' may lead a fire-extinguishing medium 112 from the distribution system 110 into the sprinkler head 130' in the same or similar manner as described above for the inlet device 132.

The sprinkler head 130' further comprises a valve device having a valve body 134*a*', a flow control device 134*b*' and a triggering device 136'. The valve device may also comprise a biasing device 134*c*' (e.g. a spring).

The valve body 134*a*' is configured to be operatively connected to the inlet device 132' of the sprinkler head 130' so that a valve body inlet consisting of a first valve body inlet 134*a*1*a* and a second valve body inlet 134*a*1*b* of the valve body 134*a*' may lead fire-extinguishing medium 112 from the distribution system 110 via the inlet device 132' into the valve body 134*a*' on the same or similar manner as described above for the valve body inlet 134*a*1 of the valve body 134*a*. The valve body 134*a*' also comprises an outlet device 132*b*' that is configured to operatively spread the fire-extinguishing medium 112 to the surroundings with fire-extinguishing or fire-dampening effect in the same or similar manner as described above for the outlet device 132*b*. The first valve body inlet 134*a*1*a* is a part of a first flow passage that allows the fire-extinguishing medium 112 to flow from the inlet 132*a*' of the inlet device 132', via the first valve body inlet 134*a*1*a* and out through the outlet device 132*b*'. The second valve body inlet 134*a*1*b* is part of a second flow passage that allows the fire-extinguishing medium 112 and/or air 114 to flow from the inlet 132*a*' of the inlet device 132', via the second valve body inlet 134*a*1*b* and out through the outlet device 132*b*'. The first flow passage and the second flow passage are described more detailedly below.

The flow control device 134*b*' is configured to operatively cooperate with the valve body 134' so that the first flow passage and the second flow passage may be closed and opened. For this purpose, the flow control device 134*b*' comprises a flow inlet 134*b*2 and a flow outlet 134*b*3. FIG. 6*a* shows how the flow control device 134*b*' holds the first flow passage and the second flow passage closed in the first non-activated state in the same or similar manner as previously described for flow control device 134*b*. FIG. 6*b* shows how the flow control device 134*b*' opens the first flow passage (see the large arrows in FIG. 6*b*) in the activated state in the same or similar manner as previously described for the flow control device 134*b*. FIG. 6*c* shows how the flow control device 134*b*' opens the second flow passage (see the large arrows in FIG. 6*c*) in the second non-activated state in a similar manner to that previously described for flow control device 134*b*. It is preferred that the flow control device 134*b*' is biased by using a biasing device 134*c*' so that the flow control device 134*b*' by means of the biasing may be pressed from a first position which closes the first flow passage in the first non-activated state (see FIG. 6*a*) to a second position which opens the first flow passage in the activated state (see FIG. 6*b*), and so that the flow control device 134*b*' may be pressed against the biasing from the first position to a third position which opens the second flow passage in the second non-activated state (see FIG. 6*c*). The biasing device 134*c*' may be of the same or similar kind as the previously described biasing device 134*c*. The flow inlet 134*b*2 of the flow control device 134*b*' and the flow outlet 134*b*3 form a part of the first flow passage and the second flow passage that allow the fire-extinguishing medium 112 and/or air to flow from the inlet 132*a*' of the inlet device 132', via valve body inlet 134*a*1*a* or 134*a*1*b* and via the flow inlet 134*b*2 of the flow control device 134*b*' and the flow outlet 134*b*3 and out through the outlet device 132*b*'.

The triggering device 136' is configured to operatively hold the valve device of the sprinkler head 130' closed in the first non-activated state and to open the valve in the activated state in the same or similar manner as previously described for triggering device 136. It is preferred that the triggering device 136' is of the same or similar kind as the triggering device 136*a*. It is further preferred that the flow control device 134*b*' which is held by the triggering device 136' is pressed by means of the biasing device 134*c*' from the first position which closes the first flow passage in the first non-activated state (see FIG. 6*a*) to the second position which opens the first flow passage in the activated state (see the large arrows in FIG. 6*b*).

As already mentioned, the flow control device 134*b*' of the valve device may in the first position close the first flow passage of the valve device in the first non-activated state (see FIG. 6*a*) and in the second position open the first flow passage of the valve device in the activated state (see the large arrows in FIG. 6*b*) so that the fire-extinguishing medium 112 may flow from the inlet device 132' through the first flow passage and out through the outlet device 132*b*', and in a third position open the second flow passage of the valve device in the second non-activated state (see large arrows in FIG. 6*c*) so that air 114 and/or fire-extinguishing medium 112 may flow from the inlet device 132' through the second flow passage and out through the outlet device 132'.

A testing device 142' may be used to influence the valve device to in the second non-activated state open the first flow passage so that air 114 and fire-extinguishing medium 112 may flow from the inlet device 132' through the first flow passage and out through the outlet device 132*b*'. The testing device 142' may, for example be a short rod-shaped part or the like that is configured to be operatively applied to the sprinkler head 130' and press the flow control device 134*b*' to the third position in the second non-activated state (see FIG. 6*c*). A disadvantage of using a short rod-like part is that the person pressing the flow control device 134*b*' to the third position must be close to the sprinkler head, which may be difficult in those cases where the sprinkler head 130' is located high up in a ceiling.

Figure 7B:
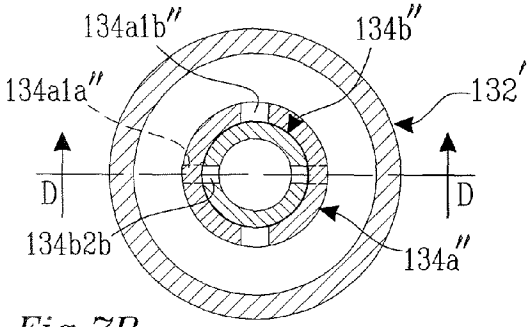
FIG. 7*b* is a schematic cross-section of the sprinkler head 130" in FIG. 7*a* viewed according to the section line E-E in FIG. 7*a*
Figure 7C:
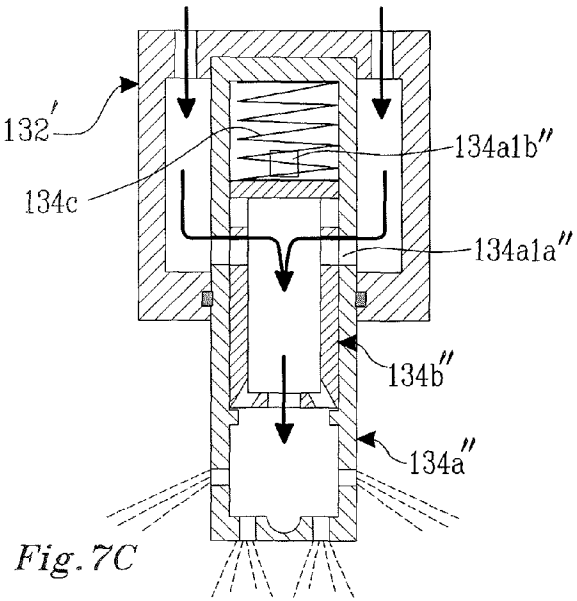
FIG. 7*c* is a schematic cross-section of the sprinkler head 130" in an activated state viewed according to the section line B-B in FIG. 7*b*.
Figure 7A:
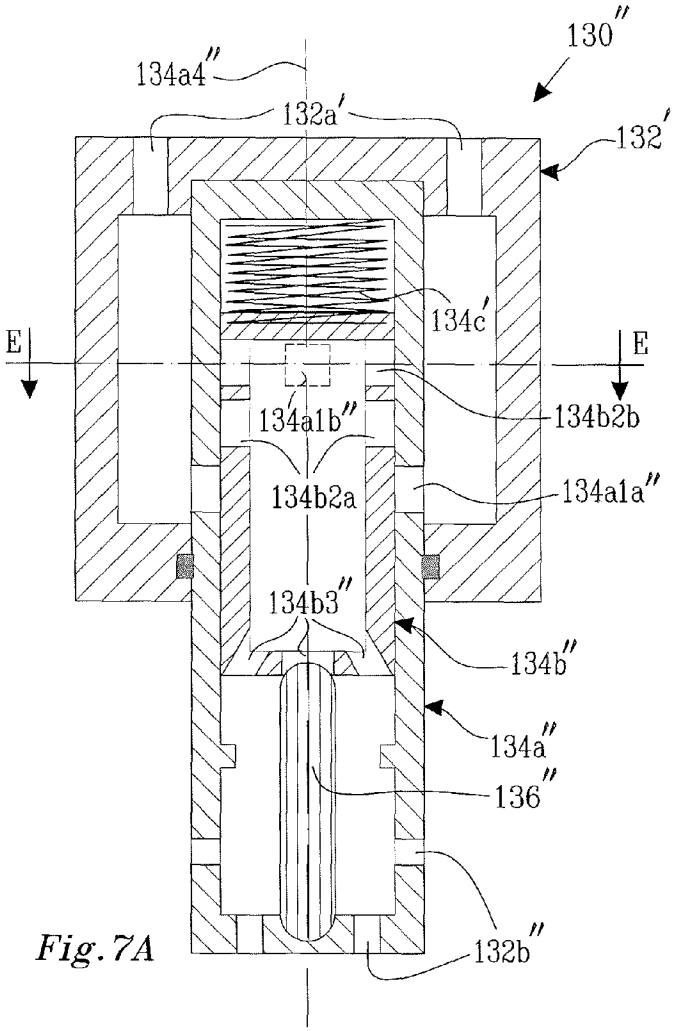
FIG. 7*a* is a schematic cross-section of the sprinkler head 130" in a first non-activated state viewed according to the section line D-D in FIG. 7*b*.
Figure 7E:
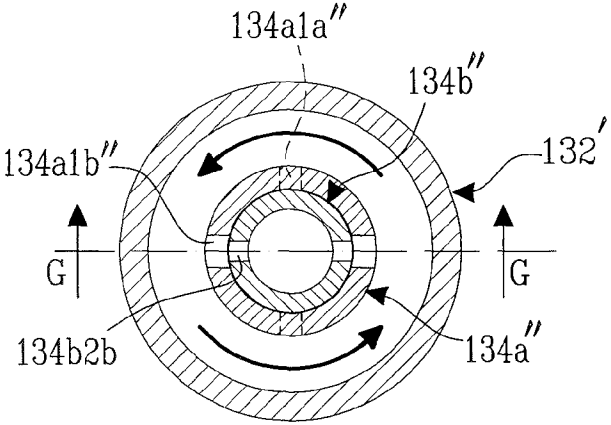
FIG. 7*e* shows the sprinkler head in the second non-activated state viewed according to the section line E-E in FIG. 7*d*.
Figure 7D:
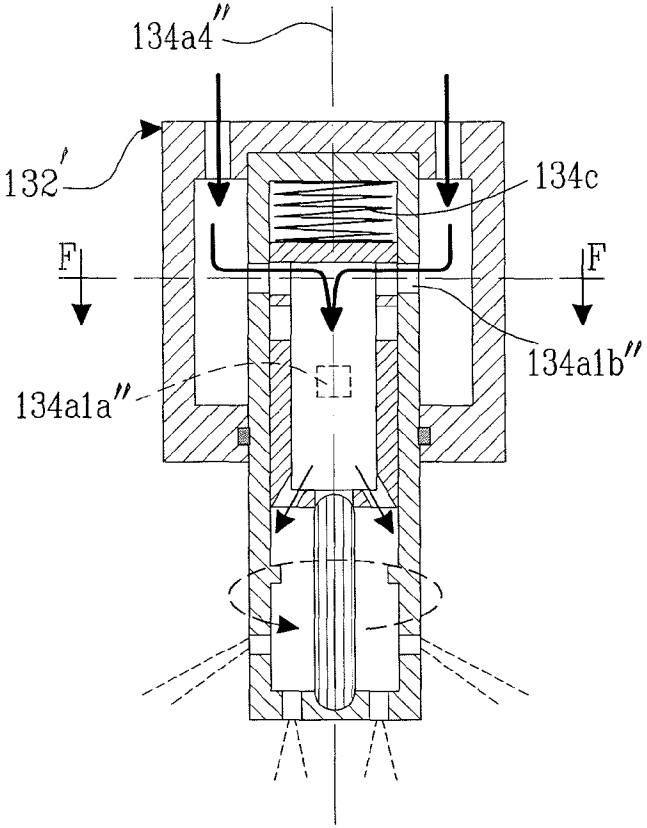
FIG. 7*d* shows the sprinkler head 130" in a second non-activated test state viewed according to the section line G-G in FIG. 7*e*.

Below a sprinkler head 130" is described with reference to FIGS. 7*a*, 7*b*, 7*c*, 7*d*, 7*e*. The sprinkler head 130" is an embodiment of the present invention. FIG. 7*a* is a schematic cross-section of the sprinkler head 130" in a first non-activated state viewed according to the section line D-D in FIG. 7*b*. FIG. 7*b* is a schematic cross-section of the sprinkler head 130" in FIG. 7*a* viewed according to the section line E-E in FIG. 7*a*. FIG. 7*c* is a schematic cross-section of the sprinkler head 130" in an activated state viewed according to the section line B-B in FIG. 7*b*. FIG. 7*d* shows the sprinkler head 130" in a second non-activated test state viewed according to the section line G-G in FIG. 7*e*. FIG. 7*e* shows the sprinkler head 130" in the second non-activated state viewed according to the section line E-E in FIG. 7*d*.

The sprinkler head 130" comprises the same or similar device inlet device 132' as sprinkler head 130. The inlet device 132' is configured to be operatively connected to the distribution system 110 such that an inlet 132*a*' of the inlet device 132' may lead a fire-extinguishing medium 112 from the distribution system 110 into the sprinkler head 130" in the same or similar manner as described above for the inlet device 132.

The sprinkler head 130" further comprises a valve device with a valve body 134*a*", a flow control device 134*b*" and a triggering device 136". The valve device may also comprise a biasing device 134*c*" (e.g. a spring).

The valve body 134*a*" is configured to be operatively connected to the inlet device 132' of the sprinkler head 130" so that a valve body inlet consisting of a first valve body inlet 134*a*1*a*" and a second valve body inlet 134*a*1*b*" of the valve body 134*a*" may lead a fire-extinguishing medium 112 from the distribution system 110 via inlet device 132' into the valve body 134*a*" in the same or similar manner as described above for valve body inlet 134*a*1 of the valve body 134*a*. The valve body 134*a*" also comprises an outlet device 132*b*' that is configured to operatively spread the fire-extinguishing medium 112 to the surroundings with fire-extinguishing or fire-dampening effect in the same or similar manner as described above for the outlet device 132*b*. The first valve body inlet 134*a*1*a*" is part of a first flow passage that allows the fire-extinguishing medium 112 to flow from the inlet 132*a*' of the inlet device 132', through valve house inlet 134*a*1*a*" and out through the outlet device 132*b*". The second valve body inlet 134*a*1*b* is part of a second flow passage that makes it possible for the fire-extinguishing medium 112 to flow from the inlet 132*a*' of the inlet device 132', via the second valve body inlet 134*a*1*b*" and out through the outlet device 132*b*'. The first flow passage and the second flow passage are described more detailedly below.

The flow control device 134*b*" is configured to operatively cooperate with the valve body 134" so that the first flow passage and the second flow passage may be closed and opened. For this purpose, the flow control device 134*b*" comprises a first flow inlet 134*b*2*a*, a second flow inlet 134*b*2*b* and a flow outlet 134*b*3". FIGS. 7*a* and 7*b* show how the flow control device 134*b*" holds the first flow passage and the second flow passage closed in a first non-activated state in the same or similar manner as previously described for flow control device 134*b*. FIG. 7*c* shows how the flow control device 134*b*" opens the first flow passage in an activated state in the same or similar manner as previously described for flow control device 134*b*'. FIG. 7*d* shows how the flow control device 134*b*" opens the second flow passage in a second non-activated state similar to previously described for flow control device 134*b*. It is preferred that the flow control device 134*b*" is held biased by means of a biasing device 134*c*" so that the flow control device 134*b*" by means of the biasing may be pressed from a first position which closes the first flow passage in the first non-activated state (see FIG. 7*a*-7*b*) to a second position which opens the first flow passage in the activated state (see FIG. 7*c*). The biasing device 134*c*" may for example be a spring device or similar.

The first flow inlet 134*b*2 of the flow control device 134*b*" and the flow outlet 134*b*3" form a part of the first flow passage which makes it possible for the fire-extinguishing medium 112 to flow from the inlet 132*a*' of the inlet device 132', via valve body inlet 134*a*1*a*" and via the first flow inlet 134*b*2*a* of the flow control device 134*b*" and the flow outlet 134*b*3" and out through the outlet device 132*b*". The first flow passage is indicated with large arrows in FIG. 7*c*.

The second flow inlet 134*b*2*b* of the flow control device 134*b*" and the flow outlet 134*b*3 form a part of the second flow passage that allows the fire-extinguishing medium 112 to flow from the inlet 132*a*' of the inlet device 132', via the second valve body inlet 134*a*1*b*" and via the second flow inlet 134*b*2*b* of the flow control device 134*b*" and the flow outlet 134*b*3" and out through the outlet device 132*b*". The second flow passage is indicated with large arrows in FIG. 7*d*. The second flow passage is opened and closed by means of the valve body 134*b*" of the valve device being arranged to operatively be rotated from a first position to a second test position and back again, i.e. the valve body 134*b*" of the valve device may be rotated from the first position to the third position which opens the second flow passage in the second non-activated state (see FIG. 7*d*-7*e*). The rotation is indicated by curved arrows in FIGS. 7*d* and 7*e*.

In the embodiment of the sprinkler head 130" shown in FIG. 6*a*-6*c* the valve body 134*b*" thus forms a second flow control device which may be rotated from a first position to a third position which opens the second flow passage in the second non-activated state.

The triggering device 136" is configured to operatively hold the valve device in the sprinkler head 130" closed in the first non-activated state and to open the valve device in the activated state in the same or similar manner as previously described for the triggering device 136. It is preferred that the triggering device 136" is of the same or similar kind as the triggering unit 136*a*. It is further preferred that the flow control device 134*b*" being held by the triggering device 136" is pressed by means of the biasing device 134*c*' from the first position which closes the first flow passage in the first non-activated state (see FIG. 7*a*) to the second position which opens the first flow passage in the activated state (see FIG. 7*c*).

As already mentioned above, the flow control device 134*b*" of the valve device may in a first position close the first flow passage of the valve device in the first non-activated state (see FIG. 7*a*) and in a second position open the first flow passage of the valve device in the activated state (see FIG. 7*c*) so that fire-extinguishing medium 112 may flow from the inlet device 132' through the first flow passage and out through the outlet device 132*b*". As also mentioned above, the valve body 134*b*" of the valve device may in a third position open the second flow passage in the second non-activated state (see FIG. 7*d*) so that air 114 and fire-extinguishing medium 112 may flow from the inlet device 132' through the second flow passage and out through outlet device 132*b*".

When the flow control device of the valve device or the like is in a first, second or third position, or when the valve body of the valve device or the like is in a first or third position described above it means that the valve device as such assumes a first, second or third position which opens and/or closes one or more flow passages, e.g. as described above.

The valve devices described above are only exemplifying embodiments of valve devices which may be arranged in a first non-activated state to close one or more flow passages and in a second activated state to open one or more flow passages so that the fire-extinguishing medium 112 may flow through the flow passage or flow passages, and in a second non-activated state to open one or more flow passages so that air 114 and/or fire-extinguishing medium 112 may flow through the flow passage or flow passages. In other words, other embodiments of the present invention may comprise other types of valve devices and/or other types of flow control devices. For example, it could be a matter of a gate valve or the like, or a seat valve or the like, where the flow control device may consist of an appropriate body (e.g. a round, rectangular or conical body) which may be lowered and raised in a valve body so that the valve is opened or closed. Alternatively, the valve device may comprise a ball valve or the like where the flow control device may be a hollow ball that rotates in a spherical seat between an open position and a closed position, or a butterfly valve or the like where flow control device may be a disc or the like which is positioned in the flow of the fire-extinguishing medium 112 and which may be rotated between an open position where the disc is set parallel to the direction of flow and a closed position where the disk is set perpendicular to the direction of flow. A valve device according to embodiments of the present invention may contain one or more valve devices. Each valve device according to embodiments of the present invention may contain one or more flow control devices. A skilled person who reads and uses this description realizes that a plurality of different valve systems may be considered.

The triggering devices as described above are only exemplifying embodiments of appropriate triggering devices which are configured to operatively hold a valve device closed in a first non-activated state and to open the valve device in an activated state. Other types of triggering devices are fully possible, which are configured to operatively hold a suitable valve device closed in a first non-activated state and to open this valve device in an activated state. It may for example be a triggering device that is based on an electric motor, piezoelectric motor, pneumatic motor or hydraulic motor or the like, or a triggering device in the form of an electro-active polymer or the like, or in the form of a so-called MicroElectroMechanical Systems (MEMS) or even in the form of a so-called NanoElectroMechanical Systems (NEMS). Some embodiments of the triggering device may be controlled by means of one or more temperature sensing sensors that measure the temperature near the sprinkler head and/or by means of microprocessors or the like, which for example are implemented by means of integrated circuits or similar.

The exemplifying embodiments described above could be summarized as follows:

The embodiments relate to a sprinkler head which comprises an inlet device configured to operationally lead a fire-extinguishing medium 112 and air 114 from a distribution system 110 into the sprinkler head, and an outlet device configured to operatively release fire-extinguishing medium 112 and air 114 from the sprinkler head, and a flow passage configured to lead fire-extinguishing medium 112 and air 114 from the inlet device to the outlet device, and a valve device configured to operatively be held in a first non-activated state by a triggering device in the sprinkler head so that the flow passage is closed, and configured to in an activated state operatively open the flow passage when the triggering device is activated in a heated state so that air 114 and fire-extinguishing medium 112 may flow from the inlet device to the outlet device. The valve device is configured to in a second non-activated test state operatively open the flow passage so that air 114 and fire-extinguishing medium 112 may flow from the inlet device through the flow passage and out through the outlet device.

The valve device may comprise at least one flow control device arranged to operatively be moved from a first position closing the flow passage in the first non-activated state to a second position opening the flow passage in the activated state when the triggering device has been activated.

It is preferred that the flow control unit is arranged within the valve body, e.g. in the valve body's 134*a*. This is however not necessary, and embodiments of the present invention may have the flow control unit arranged in another way, e.g. outside of a valve body or the like, e.g. enclosing a valve body or the like.

The flow control device may be arranged to be operatively displaced from the first position to the second position along a first axis of the sprinkler head.

The flow control device may be arranged to be operatively displaced along the first axis from the first position to the third position which opens the flow passage in the second non-activated test state.

The valve device may comprise at least a second flow control unit, which is arranged to be operatively displaced by means of being rotated around a second axis of the sprinkler head from a first position to a third position, which opens the flow passage in the second non-activated test state.

Also the valve body may be a flow control unit. Embodiments of the present invention may of course have one or more flow control units of another kind than the ones described in this text. It is preferred that the valve body is arranged outside of the flow control unit. Naturally, the valve body may be arranged in another way, e.g. inside a flow control unit or the like, e.g. such that the flow control unit encompasses the valve body or the like.

The first axis and the second axis may be the same axis.

One and the same flow control unit may be displaced or rotated (preferably along or around the same axis) both at activation caused by the triggering device and at testing (which e.g. may be performed by means of a testing device and/or manually). This makes it possible that by means of the testing (i.e. without activating the sprinkler head) check if the valve device shows enough movability to be able to be activated by means of the triggering device.

The flow control device may be configured to be operatively activated by a testing unit, so that the flow control device is displaced from the first position to the third position.

The flow control device may be configured to be operatively displaced manually from the first position to the third position.

The flow passage may comprise a plurality of flow passages where at least a first flow passage and a second flow passage run into the same outlet device, or where at least one first flow passage runs into a first outlet device and at least one second flow passage runs into a second outlet device. In this case the valve device may be configured to be operatively held in the first non-activated state by the triggering device, so that the first flow passage and the second flow passage are closed, and configured to in an activated state operatively open the first flow passage when the triggering device has been activated, so that air 114 and fire-extinguishing medium 112 may flow from the inlet device to an outlet device. The valve device may further be configured to in the second non-activated test state operatively open the second flow passage such that air 114 and fire-extinguishing medium 112 may flow from the inlet device through the second flow passage and out through the outlet device.

The exemplifying embodiments described above may also be summarized in the following way:

The embodiments relate to a method for testing sprinkler head. The sprinkler head comprises a valve device, which is held in a first non-activated state by a triggering device in the sprinkler head and closes a flow passage which is configured to lead fire-extinguishing medium 112 and air 114 from a distribution system 110 to an outlet device, which is configured to operatively release air 114 and fire-extinguishing medium 112 from the sprinkler head. The valve device is further configured to in an activated state operatively open the flow passage, when the triggering device has been activated in a heated condition, so that air 114 and fire-extinguishing medium 112 may flow from the distribution system 110 to the outlet device. The method comprises the activity to set the valve device in a second non-activated test state, which opens the flow passage such that air 114 and fire-extinguishing medium 112 may flow from the distribution system 110 via the flow passage out through the outlet device.

The method may comprise the activity to displace at least one flow control device in the valve device from a first position, which closes the flow passage in a first non-activated state to a second position, which opens the flow passage in the activated state, when the triggering device has been activated.

The method may comprise the activity to displace the flow control device from the first position to the second position along a first axis of the sprinkler head.

The method may comprise the activity to displace the flow control device along the first axis from the first position to the third position, which opens the flow passage in the second non-activated test state.

The method may comprise the activity to displace at least one second flow control device in the valve device by means of rotating the second flow control device around a second axis of the sprinkler head from a first position to a third position, which opens the flow passage in the second non-activated test state.

The first and the second axis may be the same axis.

The method may comprise the activity to displace the flow control device from the first position to the third position by means of a testing unit.

The method may comprise the activity to manually displace the flow control device from the first position to the third position.

The valve device may be configured to be operatively held in the first non-activated state by the triggering device, such that a first flow passage and at least one second flow passage are closed, and configured to in an activated state operatively open the first flow passage, when the triggering device is activated, so that air 114 and fire-extinguishing medium 112 may flow from the distribution system 110 via the first flow passage to the outlet device.

The method may comprise the activity to set the valve device in a second non-activated test state which opens the second flow passage such that air 114 and fire-extinguishing medium 112 may flow from the distribution system 110 through the second flow passage and out through the outlet device.

The present invention has now been described with reference to exemplifying embodiments. The invention is however not limited by the embodiments described in this text. On the contrary, the full width of the invention is only determined by the scope of the enclosed patent claims.

The invention claimed is:

1. A sprinkler head comprising an inlet device configured to operatively lead a fire-extinguishing medium and air from a distribution system into the sprinkler head, an outlet device configured to operatively release fire-extinguishing medium and air from the sprinkler head, a flow passage configured to lead fire-extinguishing medium and air from the inlet device to the outlet device, a valve device configured to operatively be held in a first non-activated state by a triggering device in the sprinkler head, so that the flow passage is closed, and configured to in an activated state operatively open the flow passage when the triggering device is activated in a heated state, so that air and fire-extinguishing medium may flow from the inlet device to the outlet device, wherein the valve device is configured to in a second non-activated test state operatively open the flow passage so that air and fire-extinguishing medium may flow from the inlet device through the flow passage and out through the outlet device, wherein the triggering device in the test state is maintained in an unchanged state and an unchanged position in relation to the inlet device and the outlet device, and wherein the function of the sprinkler head is maintained unchanged during the testing procedure.

2. Sprinkler head according to claim 1, wherein the triggering device is in the form of a container made of an essentially rigid material and containing a substance which expands when it is heated, such that said container cracks and collapses, wherein a state of the container is viewable external to the sprinkler head.

3. Sprinkler head according to claim 1, wherein the valve device comprises at least one flow control device arranged to operatively be displaced from a first position closing the flow passage in the first non-activated state to a second position opening the flow passage in the activated state when the triggering device has been activated.

4. Sprinkler head according to claim 3, wherein the valve device further comprises a spring device, which together with the triggering device hold the valve device biased in the first non-activated state and in that this spring device is configured to operatively be able to displace the flow control device from said first position closing the flow passage in the first non-activated state to said second position opening the flow passage in the activated state when the triggering device has been activated.

5. Sprinkler head according to claim 3, wherein the flow control device is arranged to be operatively displaced from the first position to the second position along a first axis of the sprinkler head.

6. Sprinkler head according to claim 5, wherein the flow control device is arranged to be operatively displaced along the first axis from the first position to the third position, which opens the flow passage in the second non-activated test state.

7. Sprinkler head according to claim 3, wherein the valve device comprises at least one second flow control unit which is arranged to be operatively displaced by means of being rotated around a second axis of the sprinkler head from a first position to a third position, which opens the flow passage in the second non-activated test state.

8. Sprinkler head according to claim 7, wherein the first and the second axis is the same axis.

9. Sprinkler head according to claim 6, wherein the flow control device is configured to be operatively activated by a testing unit such that the flow control device is displaced from the first position to the third position.

10. Sprinkler head according to claim 6, wherein the flow control device is configured to be operatively displaced manually from the first position to the third position.

11. Sprinkler head according to claim 1, wherein the flow passage comprises a plurality of flow passages, where at least a first flow passage and a second flow passage different from the first flow passage run into the same outlet device, or where at least one first flow passage runs into a first outlet device and at least one second flow passage runs into a second outlet device, the at least one first flow passage different from the at least one second flow passage.

12. Sprinkler head according to claim 11, wherein the valve device is configured to be operatively held in the first non-activated state by the triggering device, so that the first flow passage and the second flow passage are closed, and configured to in an activated state operatively open the first flow passage when the triggering device has been activated, so that air and fire-extinguishing medium may flow from the inlet device to an outlet device, and wherein the valve device is configured to in the second non-activated test state operatively open the second flow passage such that air and fire-extinguishing medium may flow from the inlet device through the second flow passage and out through the outlet device.

* * * * *